US011280254B2

(12) United States Patent
Mercier

(10) Patent No.: US 11,280,254 B2
(45) Date of Patent: Mar. 22, 2022

(54) TWO STROKE ENGINE WITH VALVES ACTUATED BY AIR PRESSURE NEAR BOTTOM DEAD CENTER

(71) Applicant: Cesar Mercier, Roseland, NJ (US)

(72) Inventor: Cesar Mercier, Roseland, NJ (US)

(73) Assignee: Cesar Mercier, Roseland, NJ (US)

( * ) Notice: Subject to any disclaimer, the term of this patent is extended or adjusted under 35 U.S.C. 154(b) by 446 days.

(21) Appl. No.: 16/328,385

(22) PCT Filed: Aug. 30, 2017

(86) PCT No.: PCT/US2017/049307
§ 371 (c)(1),
(2) Date: Feb. 26, 2019

(87) PCT Pub. No.: WO2018/044995
PCT Pub. Date: Mar. 8, 2018

(65) Prior Publication Data

US 2021/0293177 A1 Sep. 23, 2021

Related U.S. Application Data

(60) Provisional application No. 62/381,260, filed on Aug. 30, 2016.

(51) Int. Cl.

| | |
|---|---|
| ***F02B 25/16*** | (2006.01) |
| ***F02B 25/20*** | (2006.01) |
| ***F02B 75/30*** | (2006.01) |
| ***F02B 75/02*** | (2006.01) |

(52) U.S. Cl.
CPC ..... *F02B 25/16* (2013.01); *F02B 25/20* (2013.01); *F02B 75/02* (2013.01); *F02B 75/30* (2013.01); *F02B 2075/025* (2013.01); *F02B 2700/037* (2013.01)

(58) Field of Classification Search
CPC ..... F02B 225/16; F02B 25/20; F02B 75/02; F02B 75/30; F02B 75/40; F02B 2075/025; F02B 2700/037; F01M 1/02; F01M 11/00; F02F 3/24
See application file for complete search history.

(56) References Cited

U.S. PATENT DOCUMENTS

| | | | | | |
|---|---|---|---|---|---|
| 1,461,948 | A * | 7/1923 | Stosik | F02B 25/00 | 123/69 R |
| 2,645,214 | A * | 7/1953 | Birnstiel | F02B 25/00 | 123/74 AE |
| 5,050,570 | A * | 9/1991 | Thring | F02G 3/02 | 123/556 |
| 8,215,268 | B2 * | 7/2012 | Barberato | F02B 75/28 | 123/51 R |
| 2006/0124086 | A1 * | 6/2006 | Fabrega | F02B 25/24 | 123/73 PP |
| 2010/0108037 | A1 * | 5/2010 | Moro | F02B 75/044 | 123/48 B |

* cited by examiner

*Primary Examiner* — Grant Moubry

(57) ABSTRACT

A two-stroke engine with valves near bottom dead center that are adapted to prevent intake charge from exiting exhaust ports, wherein the valves are actuated by air pressure difference.

9 Claims, 1 Drawing Sheet

SECTION AT-AT
SCALE 1 : 2

SECTION AS-AS
SCALE 1 : 2

SECTION BS-BS
SCALE 1 : 2

TWO STROKE ENGINE WITH VALVES ACTUATED BY AIR PRESSURE NEAR BOTTOM DEAD CENTER

BACKGROUND OF THE INVENTION

This engine provides a new configuration for a two stroke engine to incorporate advantages found in a four stroke engine, such as: oil sump, exhaust and intake valve. This engine also incorporates advantages found in a two stroke engine as well, such as forced induction without the need for a turbo or super charger.

SUMMARY OF THE INVENTION

It is an object of this invention to provide a two-stroke engine with a separate lubrication system that works substantially identical to that of a four-stroke, whereas no need to pre-mix fuel and oil in order to lubricate moving parts.

It is another object of this invention to use valves to control exhaust and air intake charge with forced induction to achieve a high compression ratio without intake charge escaping to the exhaust ports.

It is another object of this invention to provide a piston seat that provides a normal force to support a follower or a connected rod to a shaft while managing the side thrusts of the piston throws by redirecting the related forces to the engine block rather to the cylinder walls.

DETAIL DESCRIPTION OF THE PREFERRED EMBODIMENTS

Figure 1A:
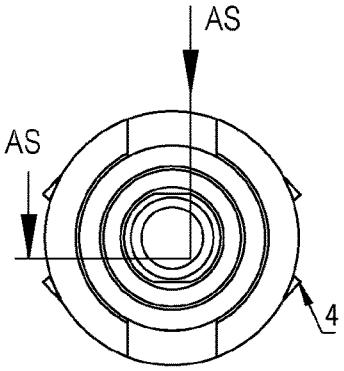
FIG. 1A shows a bottom view of an engine module made of a cylinder liner with valves, a movable piston, and a stationary piston.

FIG. 1A is a bottom view of the preferred embodiment of a new engine module which incorporates the advantages of both two-stroke and four-stroke combined. Component 4 are new valves added to this new engine which will be discussed later.

Figure 1B:
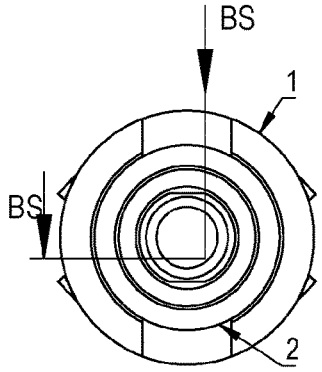
FIG. 1B also shows a bottom view of an engine module comprising a cylinder liner with valves, a movable piston, and a stationary piston.

FIG. 1B is also a bottom view of this new engine. A movable piston 2, functions within a cylinder liner 1, which is designed to function inside of an engine block. The cylinder liner can be adapted to become the engine block as well.

Figure 1C:
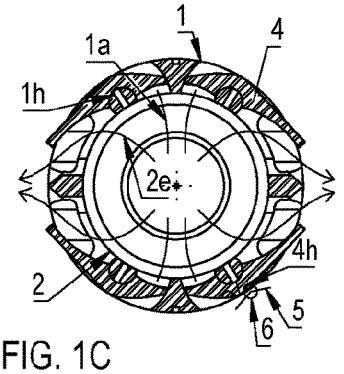
FIG. 1C shows a cross section view of the engine module in FIG. 1B.

FIG. 1C is a cross section view taken from the side to illustrate the flow of the exhausts 2*e* and air or intake charge 1*a*. The valves 4 pivot on a mounted point on the cylinder liner 1 to open and close transfer ports and exhaust ports respectively. Note that the valves may pivot on other components, and more than one valve may be used in connection with rockers to open and close exhaust and intake ports located near bottom dead center. The valves have two sides: one is adapted to close the exhaust port, while the other side is adapted to close the transfer ports. The valve side on the exhaust side is longer, but not necessary, in order to facilitate the exhaust pressure to push the valve open. Due to inertia, the valve side facing the exhaust ports will continue to keep the exhaust ports closed as the movable piston moves up towards top dead center. Optionally, the valves may be coupled with a rocker assemble. At the end of a combustion event, the exhaust pressure pushes on one side of the valve to push it open and to escape. At the same time, the intake charge from the rear compression chamber pushes on the other side of the valve to push it open to allow the charge to escape to the combustion chamber. This in turn closes the exhaust ports trapping the intake charge in the combustion chamber to be compressed and ignited near top dead center. A scavenging process takes place as some of the exhaust is left in the combustion chamber. The forced induction, due to the compressed charge from the rear compression chamber pushes the valve open while at the same time closes the exhaust ports to trap and to allow the intake charge to be transferred or injected into the combustion chamber. Greater compression ratio is achieved due to the fact that the intake charge is injected under pressure into the combustion chamber. This eliminates the need to have a turbo charger or super charger. Optionally, a spring 5 is used to push on a rocker 6 to seat in a cavity 4*h* in valve 4. This action causes the valves to remain shut, closing the exhaust ports and preventing the intake charge from escaping with the exhaust while the movable piston 2 moves up towards Top Dead Center (TDC). Cavity 1*h* is used to lubricate the respective components.

Figure 1D:
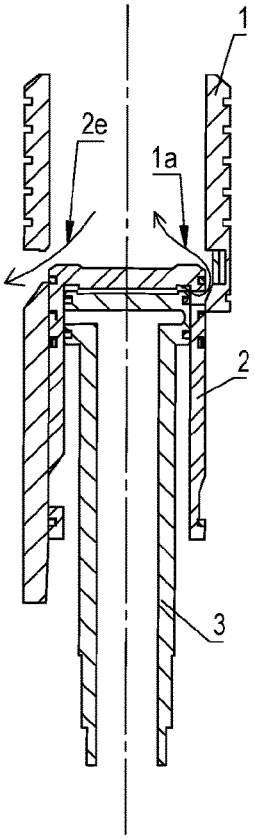
FIG. 1D is a cross section view taken from the side to illustrate exhaust and air intakes while the movable is near bottom dead center.

FIG. 1D is a cross section view showing exhaust 2*e* leaving the exhaust ports on the cylinder liner 1. This cross section view also shows the intake charge 1*a* being transferred to the combustion chamber. A port near the crown of the movable piston 2 is open to allow the compressed charge that was trapped within the rear compression chamber which is formed underneath the movable piston and above the stationary piston 3.

Figure 1E:
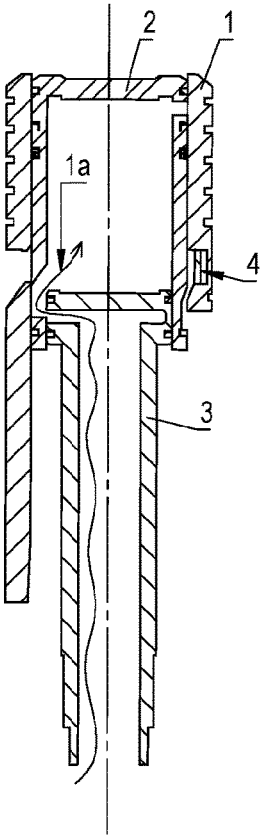
FIG. 1E is a cross section view of the engine module to illustrate air intake charge flow while the movable is near top dead center.

FIG. 1E is a cross section view of the engine module showing intake charge 1*a* passing through the stationary piston and into the rear compression chamber. Intake charge is sucked in the rear compression chamber as the sealed chamber underneath the movable piston is increased when the movable piston moves up towards TDC. Optionally, the intake charge may enter the rear compression chamber through a reed valve or check valve. The intake charge may enter the rear compression chamber through transfer ports on the cylinder walls and through ports on the skirt of the movable piston.

Figure 1F:
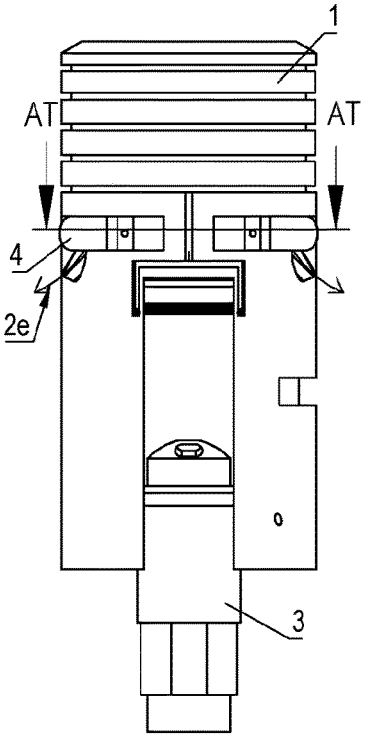
FIG. 1F is a side view of the engine module to illustrate the valves 4.

FIG. 1F is a side view of the engine module showing exhausts 2*e* escaping the cylinder liner 1 pushing through the valves 4. The grooves on the cylinder liner 1 are cavities to allow coolants to cool the cylinder liner and engine block.

Not included in this drawing page is a piston seat that is adapted to transfer the force from the combustion event to the engine shaft via transmission gears or cam follower. This piston seat is equipped with bearing to glide on the engine block and substantially provide a force normal to a rotatable bearing, forming a follower, with an adjacent face to a cam that turns the engine shaft directly or indirectly, wherein the follower face curve matches that of the cam profile curve when the follower is about bottom dead center which is the location on the cam profile which is further from the axis of the cam. The movable piston seats on the piston seat component. A follower component seats on the piston seat to push a cam which turns a shaft directly or indirectly.

The invention claimed is:

1. A two stroke engine comprising:

a) A cylinder with at least one exhaust port near bottom dead center, b) a movable piston operating within the cylinder forming a combustion chamber and adapted to indirectly transmit the force from the combustion event towards a rotary shaft, c) a stationary piston operating within the movable piston forming a rear compression chamber other than that of the engine crank case, d) at least one valve, mounted near bottom dead center to close the at least one exhaust port, and adapted to trap the intake charge from the rear compression chamber into the combustion chamber, wherein the at least one valve is pushed open by the exhaust pressure leaving the combustion chamber, wherein the at least one valve is then pushed back, closing the at least one exhaust port, trapping the intake charge entering the combustion chamber from the rear compression chamber due to dropping pressure in the combustion chamber from exhaust escaping.

2. A two stroke engine according to claim 1, wherein intake charge enters the rear compression chamber through at least one intake port near bottom of the stationary piston, then through at least one transfer port near the crown of the stationary piston, then through at least one port on the bottom skirt of the movable piston.

3. A two stroke engine according to claim 1, wherein intake charge enters the rear compression chamber through at least one intake port near bottom of the stationary piston, then through at least one check valve on the crown of the stationary piston.

4. A two stroke engine according to claim 1, wherein intake charge enters the rear compression chamber through at least one transfer port near bottom of the skirt of the movable piston.

5. A two stroke engine according to claim 1, wherein intake charge enters the combustion chamber through at least one transfer port near the crown of the movable piston while near bottom dead center, then by pushing on the other side of the at least one valve to close the at least one exhaust port.

6. A two stroke engine according to claim 1, wherein intake charge enters the combustion chamber through at least one transfer port on the cylinder wall near the crown of the movable piston while near bottom dead center, then by pushing on the other side of the at least one valve to close the at least one exhaust port.

7. A two stroke engine according to claim 1, wherein intake charge enters the combustion chamber through at least one transfer port on the cylinder wall near the crown of the movable piston while near bottom dead center, then by pushing on the other side of the at least one valve to close the at least one exhaust port, wherein crankcase is used as rear compression chamber.

8. The two stroke engine according to claim 1 wherein the at least one valve is located near bottom dead center and is actuated by air pressure difference between exhaust gas pressure and intake charge pressure, wherein the at least one valve has two sides and pivots about the center of the two sides, wherein one side of the valve is adapted to close the exhaust port while the other side of the valve opens the at least one transfer port so as to allow the compressed charge to push the exhaust ports close then enter the combustion chamber.

9. The two stroke engine according to claim 1 wherein the at least one valve is actuated by a rocker assembly.

* * * * *